United States Patent [19]

Fry

[11] 3,984,040

[45] Oct. 5, 1976

[54] DECK NAILING APPARATUS

[76] Inventor: Arnold H. Fry, 2505 Englewood Drive, Columbus, Ohio 43219

[22] Filed: Nov. 7, 1973

[21] Appl. No.: 413,614

[52] U.S. Cl. ..... 227/7; 227/111

[51] Int. Cl.[2] ..... B27F 7/02

[58] Field of Search ..... 227/2, 6, 7, 111

[56] References Cited

UNITED STATES PATENTS

| | | | |
|---|---|---|---|
| 1,286,740 | 12/1918 | Oehm et al. | 227/111 |
| 2,915,754 | 12/1959 | Wandel | 227/111 X |
| 3,764,053 | 10/1973 | Thompson | 227/111 |
| 3,771,708 | 11/1973 | De Nicola et al. | 227/111 |
| 3,796,365 | 3/1974 | Downing | 227/111 |

*Primary Examiner*—Granville Y. Custer, Jr.
*Attorney, Agent, or Firm*—Mahoney & Stebens

[57] ABSTRACT

A deck nailing apparatus is provided having a wheeled carriage for traversing a surfaced structure, and a pair of nail driving devices which are supported by the wheeled carriage in operative relationship to the surface for the driving of nail devices. Control means is incorporated in the apparatus and coupled in controlling relationship with the nailing devices to cause operation of the devices in proportional relationship to the distance traversed by the apparatus. This control means comprises a cam wheel resiliently supported on the carriage to maintain rolling engagement with the structure surface traversed by the apparatus.

8 Claims, 7 Drawing Figures

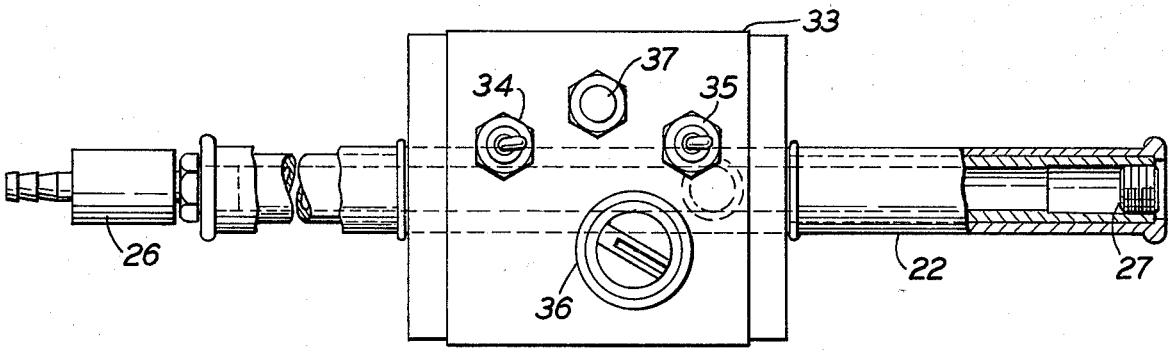
Fig 3
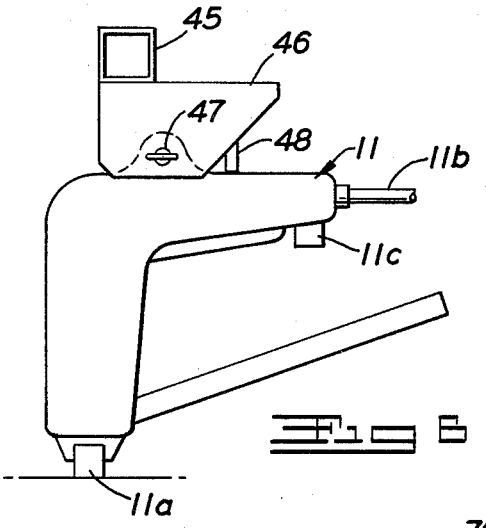
Fig 6
Fig 4
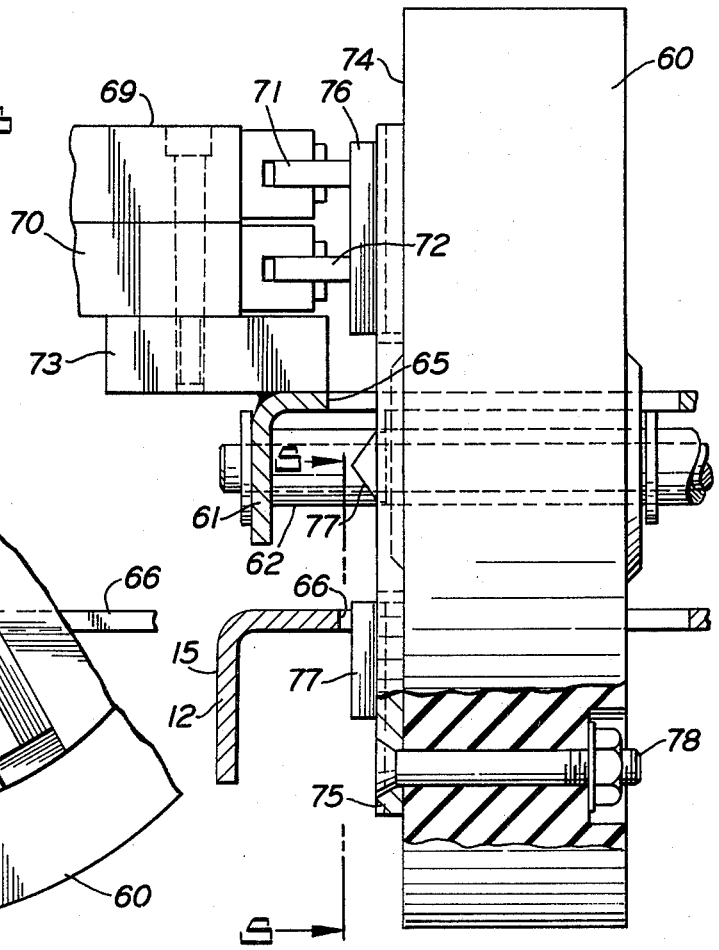
Fig 5
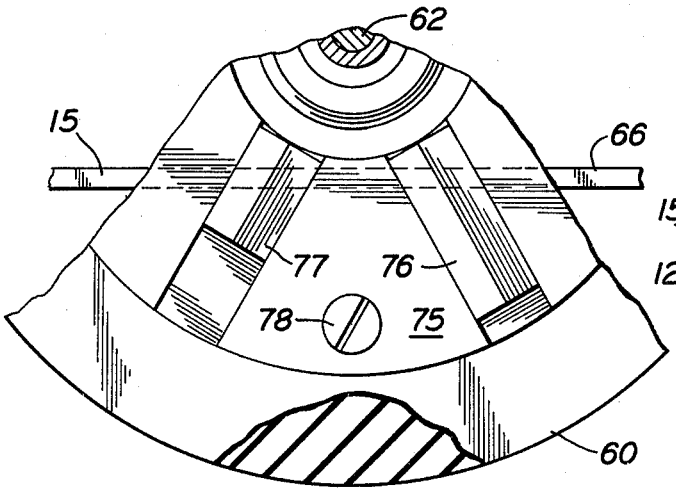

DECK NAILING APPARATUS

BACKGROUND OF THE INVENTION

Construction of buildings, such as apartments and small office buildings frequently utilize techniques wherein large surface areas must be covered with sheathing, as for example, plywood. This necessitates substantial nailing wherein, for reasons of economy, powered nailing devices are employed to reduce the time and labor required for nailing of plywood sheathing to supporting joists or rafters. For this purpose, a variety of air powered nailing guns have been developed in an attampt to bring a degree of automated fabrication to the building construction industry.

All of the air powered nailing devices incorporate a basic driving mechanism which is automatically fed with nail type fasteners which are carried in a suitable magazine. Operation of the nailing devices require that a worker manually support and apply the nailing gun to the work surface. An automatic firing mechanism is usually porvided so that contact of the gun nose with the work surface will result in actuation of the mechanism for driving of a nail into that surface. As will be readily apparent, there is still a substantial amount of manual labor that is required to utilize a nailing gun of this type. The worker must physically carry and support the gun, and this can only be effectively accomplished in a very tiring, stooped or kneeling position. The worker must also carry the gun along a relatively straight line for substantial distances and place the gun in contact with the work surface at specified intervals to maintain a required nail spacing. This means that the worker must have some means of guidance as to the nail spacing which either requires additional manual labor in setting up or the worker will merely estimate the distance at which the nails are to be driven. The latter technique usually results in the worker estimating at a relatively closer spacing, and this works a further economic disadvantage in that a greater number of nails are utilized than that required or specified.

SUMMARY OF THE INVENTION

In accordance with this invention, a nailing apparatus is provided to substantially reduce the work effort required in attaching plywood sheathing to the building structural elements. This apparatus also permits driving of the nails or other fastening devices in a precise predetermined spaced relationship for greater economy of operation and assurance that contractural specifications will be met satisfactorily. In order to further effect time savings for greater economy, the apparatus is constructed to utilize the more conventional and commercially available nailing devices. This permits a single worker to inherently double his possible work output with the actual work output being more than doubled through a reduction in the actual physical labor required for performing the nailing operations. The worker is thus enabled to sustain a higher output over a substantially long period of time.

The deck nailing apparatus of this invention comprises a wheeled carriage which is provided with two nailing guns that are automatically operated in response to traversing movement of the carriage over the surface to be nailed. Two nailing guns are mounted on the carriage by adjustable means readily permitting the guns to be relatively adjusted for simultaneous nailing along two spaced parallel lines. Automatic operation of each gun is effected by a control wheel which is also mounted on the carriage for rolling engagement with the surface that is traversed. This control wheel is interconnected by circuit means with each gun and is operative to cause actuation of each gun at predetermined intervals along the work surface. Additonal control elements are incorporated to provide selectivity as to nail spacing and separate or simultaneous operation of the two nailing guns.

These and other objects and advantages of this invention will be readily apparent from the following description of an embodyment thereof and the accompanying illustrative drawings.

DESCRIPTION OF THE DRAWING FIGURES

FIG. 3 is a top plan view of the control handle as seen along a plane extending through line 3—3 of FIG. 1.

FIG. 4 is a fragmentary vertical sectional view on an enlarged scale taken along line 4—4 of FIG. 1.

FIG. 5 is a fragmentary side elevational view of the control wheel taken along line 5—5 of FIG. 4.

FIG. 6 is a side elevational view of a nailing gun suspended from a mounting bracket.

DETAILED DESCRIPTION OF THE ILLUSTRATIVE EMBODIMENT

Figure 1:
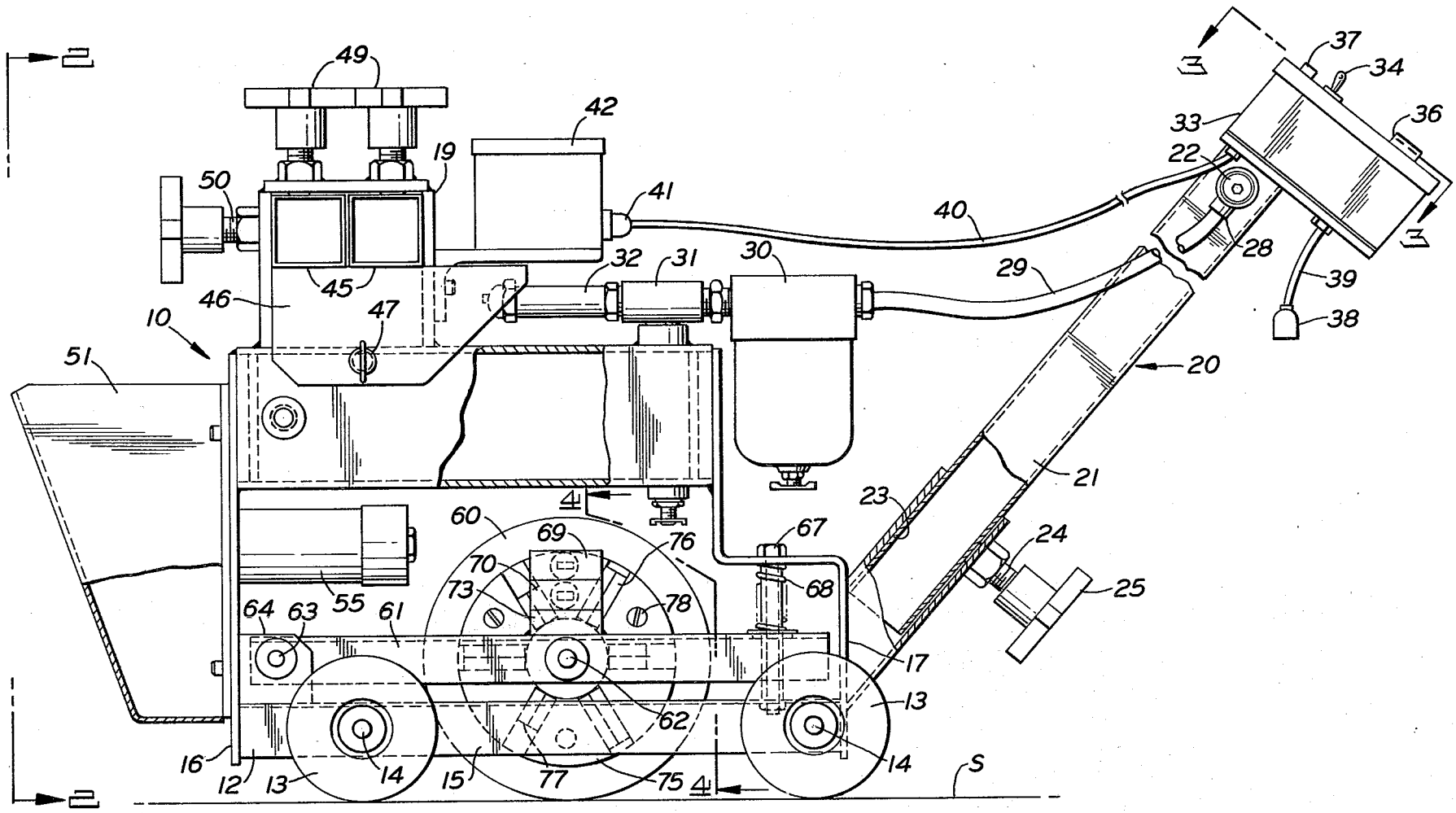
FIG. 1 is a side elevational view of a deck nailing apparatus embodying this invention.
Figure 2:
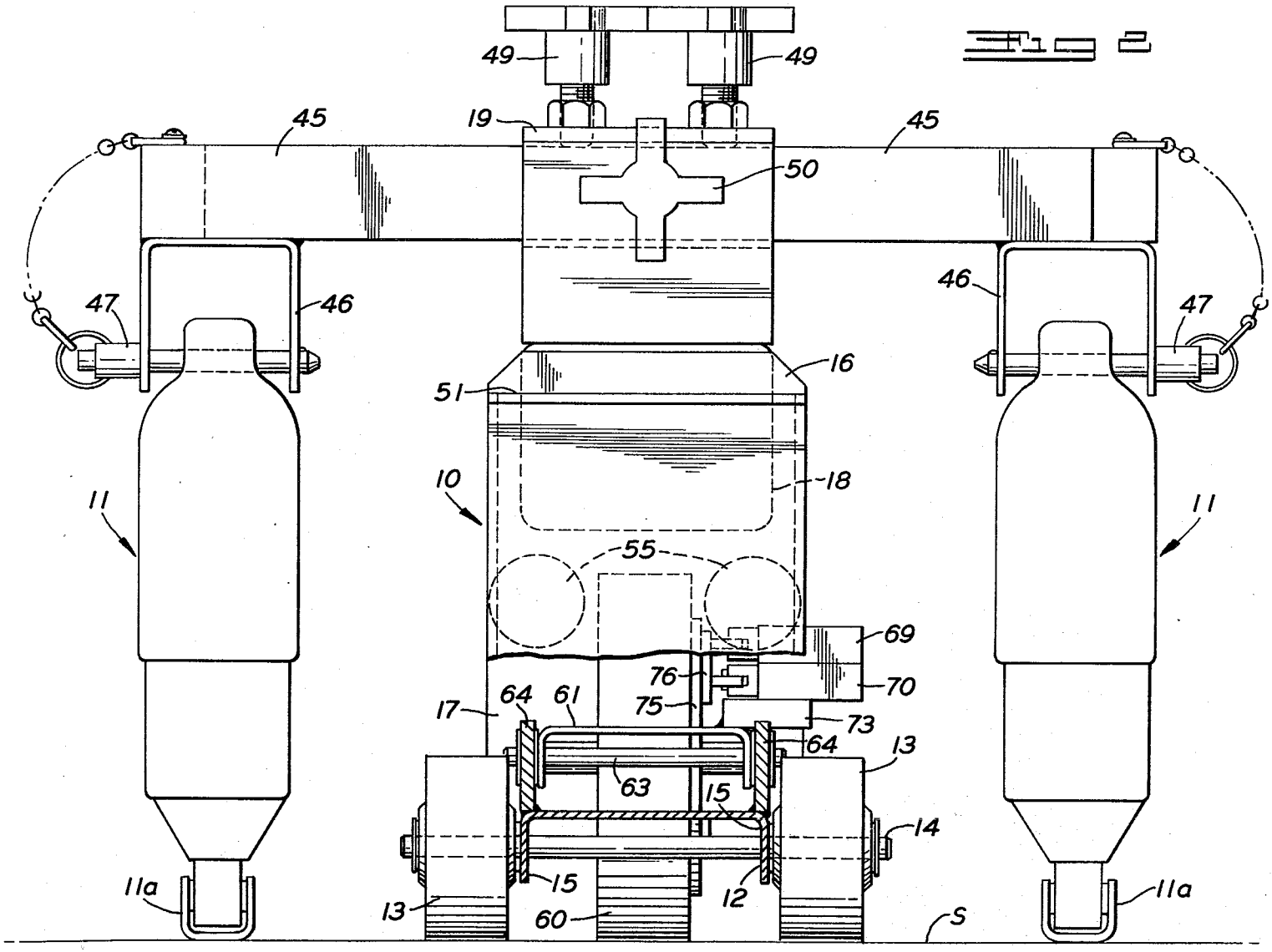
FIG. 2 is a front elevational view of the apparatus as seen along a plane extending through line 2—2 of FIG. 1.

A deck nailing apparatus embodying this invention is illustrated in its entirety in FIGS. 1 and 2 of the drawings. This apparatus comprises a wheeled carriage 10 on which are mounted two nailing guns 11 which are shown illustratively in FIG. 2. These nailing guns 11 may be any of the commerciially available type guns which are designed for driving of a suitable fastening device. The nailing guns are of a type designed to be supported by mechanical apparatus and include a socket formed in the top portion for mechanical attachment. These fastening devices are not illustrated; however, for purposes of description and understanding of this invention, it is assumed these devices are elongated nails adapted to be driven through a plywood sheathing for securing that sheathing to a supporting framework. The uppermost surface of an exemplary sheathing is indicated in the several figures by the letter S. It will also be understood that while the sheathing surface S is indicated as being horizontally disposed, this surface may also be inclined as in a roof with the degree of inclination preferably limited to readily permit a worker to propel the nailing apparatus over this surface.

The wheeled carriage 10 includes a structurally rigid framework having a base channel 12 on which the four wheels 13 are journaled. Each of the wheels 13 is mounted on a respective one of two axles 14, and the wheels are thus mounted in pairs. These axles 14 extend through downwardly extending flanges 15 of the base channel 12 in transversely disposed relationship to the longitudinal axis of the channel. Each of the wheels 13 may be of any readily available type but are preferably formed with an outer rubber tread to prevent slipping of the apparatus on the sheathing surface.

Extending upwardly from and secured to the base channel 12 are a pair of end plates 16 and 17. Positioned at the respective ends of the channel disposed between the end plates at their upper ends is an air tank 18 and an arm supporting bracket 19.

Attached to the end plate 17 is a handle assembly 20 by which the worker may readily control the direction of movement of the device and provide a convenient means of bringing the necessary electrical power and pressurized air to the apparatus. This handle assembly includes an elongated tubular shaft 21 having a cross handle 22 secured to one end thereof. The opposite end of the shaft 21 is inserted into a tubular socket 23 which is rigidly attached to the end plate 17. The shaft 21 is axially movable within the socket 23 to a selected position providing the desired heighth adjustment and is completely removable to reduce the size of the apparatus for transport and storage. A clamp screw 24 threaded into socket 23 is operable to secure the shaft 21 in a desired selected position. This clamping screw 24 has a hand wheel 25 fixed on the outer end thereof to facilitate adjustment.

The cross handle 22 comprises an open ended tubular pipe which is rigidly fixed to the upper end of the shaft 21. An air supply hose connector-fitting 26 is threaded into one end of the cross handle 22 while the other end is blocked by a plug 27. The fitting 26 and plug 27 may be interchanged as desired by a particular operator. Formed with the cross handle 22 at a point adjacent the shaft 21 is a hose coupling 28. This hose coupling communicates with the interior of the hollow cross handle 22 and also connects with a flexible hose 29 which extends along the shaft 21 and connects with the air tank 18. Interposed in circuit with the hose 29 is a lubrication device 30 which is positioned immediately preceding the air tank. A T-fitting 31 is provided at the inlet of the tank 18 and supports the lubrication device 30. A safety valve 32 is also attached to the T-fitting 31 to prevent build-up of excessive air pressure in the tank.

Also mounted on the outer end of the shaft 21 is a control box 33 containing the electrical switches providing the selective control over operation of the nailing guns 11. This control box includes two toggle type switches 34 and 35 which are operated to enable operation of the respective nailing gun designated as either the right or left gun. In this illustrative embodiment, a selector switch 36 is also provided for energization of the electrical circuit and optional selection of operation as to either of two predetermined nail spacings. An auxiliary push button switch 37 is provided to permit single operation of either or both guns as determined by the respective switches 34 and 35.

Electrical power for operation of the electrical portions of the control circuit is provided by an external source connectible with the apparatus through an electrical cable (not shown). Interconnection of an electrical power cable with the apparatus is conveniently accomplished through a connector socket 38 having a short length of cable 39 attached thereto and which extends into the control box 33 where the individual conductors are connected into the circuit. A cable 40 extending from the control box 33 connects by a socket 41 with a circuit junction box 42 attached to the arm supporting bracket 19.

Each of the nailing guns 11 is supported on the apparatus by a respective arm 45 secured in the bracket 19. These arms 45 are elongated tubes of square cross-section having one end portion extending into an opening in the bracket 19 and projecting a distance transversely at opposite sides of the apparatus. The nailing guns 11 are each suspended from a respective arm 45 at the outer end by a U-shaped mounting bracket 46 secured in inverted relationship to the arm. A single point suspension is utilized for mounting of the guns with this mounting comprising a pin 47 projecting through the flanges of the bracket and a mounting socket in the top portion of the gun. The pins 47 are preferably of a self-locking type as illustrated in FIG. 2 with the brackets 46 oriented to permit the guns to freely pivot in a vertical plane disposed parallel to the longitudinal axis of the apparatus. This pivotal mounting of nailing guns is best seen in FIG. 6, and it will be noted that the pin socket is located relative to the center of gravity as to result in the guns pivoting in a direction whereby the nose 11a will tend to move downwardly and assure contact with the sheathing surface. A limit stop 48 may be provided to restrict pivotal movement in that direction. A pair of vertical clamp screws 49 with respective handwheels are threaded into the top of the bracket 19 and a single clamp screw 50 with handwheel is threaded into the front of the bracket to rigidly clamp the arms 45 in a position where the nailing guns 11 are at a desired lateral spacing.

It will be noted that the carriage 10 is provided with a receptacle 51 for storage and transport of a limited supply of nail or other fastener cartridges. This receptacle 51 comprises an open-topped container secured to the forward wall of the end plate 16. Each of the nailing guns 11 includes a magazine which receives a cartridge containing a predetermined number of nails or other type fastener, and the cartridge supply carried in the receptacles minimizes the time required for reloading of the nailing guns which are capable of utilizing a large number of nails.

Operation of the two nailing guns 11 in the illustrative embodiment is effected by compressed air. This compressed air is retained in the air tank 18 which functions as an accumulator reservoir to assure operation of the two guns from a single air supply source. Each of the guns 11 is provided with a main air supply inlet 11b as seen in FIG. 6 and an actuating valve 11c operated by pilot air. An electric soleniod-operated air valve 55 is interposed in a pilot air line 56 comprising a flexible hose connecting with the pilot valve 11c and the tank 18. The main inlet 11b is connected to the tank 18 by a flexible hose 57. It will be noted that each gun 11 has its own respective solenoid valve 55 and may be independently operated.

In accordance with this invention, control over operation of the solenoid valves 55 in a normal operating mode is effected by means of a control wheel 60 which is mounted on the carriage 10. The control wheel 60 is preferably formed from a resilient material such as rubber and is journaled on an elongated supporting channel 61 by an axle and bearing assembly 62. The channel 61 is disposed in inverted relationship and extends longitudinally of the carriage in upwardly spaced relationship to the base channel 12. The forward end of the channel 61 is pivoted on a transversely extending shaft 63 which is supported by upstanding brackets 64 secured to the upper surface of the base channel 12. As can be best seen in FIGS. 1 and 2, the relationship of the control wheel 60 and its mounting in an upright, longitudinally alligned position is such that the control wheel will be in rolling engagement with the surface S on which the carriage wheels 13 are also positioned. The control wheel 60 is also positioned in the center of the channel 61 and projects through an opening 65 in that channel as well as an opening 66 formed in the base channel 12. This pivotal mounting of the control wheel 60 permits the control wheel to move vertically and thereby accommodate any irregularities in the surface S and thereby assure that the control wheel will be in engagement with the surface at all times during operation of the apparatus.

To further assure that the control wheel 60 will be maintained in engagement with the surface S, a spring biasing means is interconnected between the channel 61 and the end plate 17. As can be best seen in FIG. 1, this spring biasing means comprises a bolt 67 extending between the base channel 12 and an offset portion of the plate 17 with a helical compression spring 68 interposed between the upper surface of the channel 61 and the end plate 17. The length of the spring 68 is selected to maintain the control wheel 60 against the surface S and permit limited movement of the channel 61 relative to the illustrated horizontal position.

This mounting of the control wheel 60 to permit vertical oscillation is essential to simultaneous operation of two nailing guns 11 mounted on a wheeled carriage 10 of an apparatus embodying this invention. Plywood sheathing as applied to floors or roof decks has many surface irregularities and undulations that require flexibility in mounting of the control wheel in order that these factors will be accommodated. While nailing guns have been constructed with actuating mechanisms providing automatic operation of the gun in response to relative traversing movement over a work piece, such independently controlable guns are not readily adaptable to an apparatus of this invention where operation and transport of two guns is accomplished. The utilization of a single control wheel enables an operator to selectively control either gun while employing a minimum of control components in the control system which is responsive in the first instance to the control wheel.

Also mounted on the channel 61 in fixed relationship thereto are a pair of electrical switches 69 and 70. These switches are preferably of a type designated as micro switches and are provided with respective actuating levers 71 and 72. Both switches 69 and 70 are mounted on a bracket 73 attached to the channel 61 in vertically stacked relationship with both switches oriented to direct their actuating levers 71 and 72 toward a vertical sidewall 74 of the control wheel 60.

Operation of the switches 69 and 70 is effected in response to the rotation of the control wheel 60. For this purpose, the control wheel is provided with a cam plate 75 having a plurality of cam lobes 76 and 77 which are attached to the outer vertical surface of the plate in angularly spaced relationship. The cam plate 75 of the illustrative embodiment comprises a circular plate which is fastened to the vertical sidewall 74 of the control wheel by three bolts 78. There are six cam lobes 76 and 77 which project a distance laterally outward of the plate's vertical surface in operative relationship to the actuating levers 71 and 72 of the switches. Accordingly, rotation of the control wheel 60 will result in the cam lobes 76 and 77 sequentially engaging the levers 71 and 72 thereby actuating the respective switches 69 and 70. Three of the cam lobes 76 are of a length to simultaneously engage both switch levers 71 and 72 while the three remaining cam lobes 77 are only capable of engaging only the switch lever 72. This angular spacing of the cam lobes and difference in length is designed to provide two different spacings at which the nails will be driven into the sheath S. For example, in this embodiment, the wheel 60 is of a diameter such that circumferential segments defined by adjacent cam lobes are of an arc length to result in the nails being selectively placed at either 3 inches or 6 inches intervals. This is a commonly accepted nail spacing most commonly utilized in the building industry. It will be noted, however, that a different nail spacing may be readily obtained through changes in either the diameter of the control wheel 60 or in the number and spacing of the cam lobes.

Figure 7:
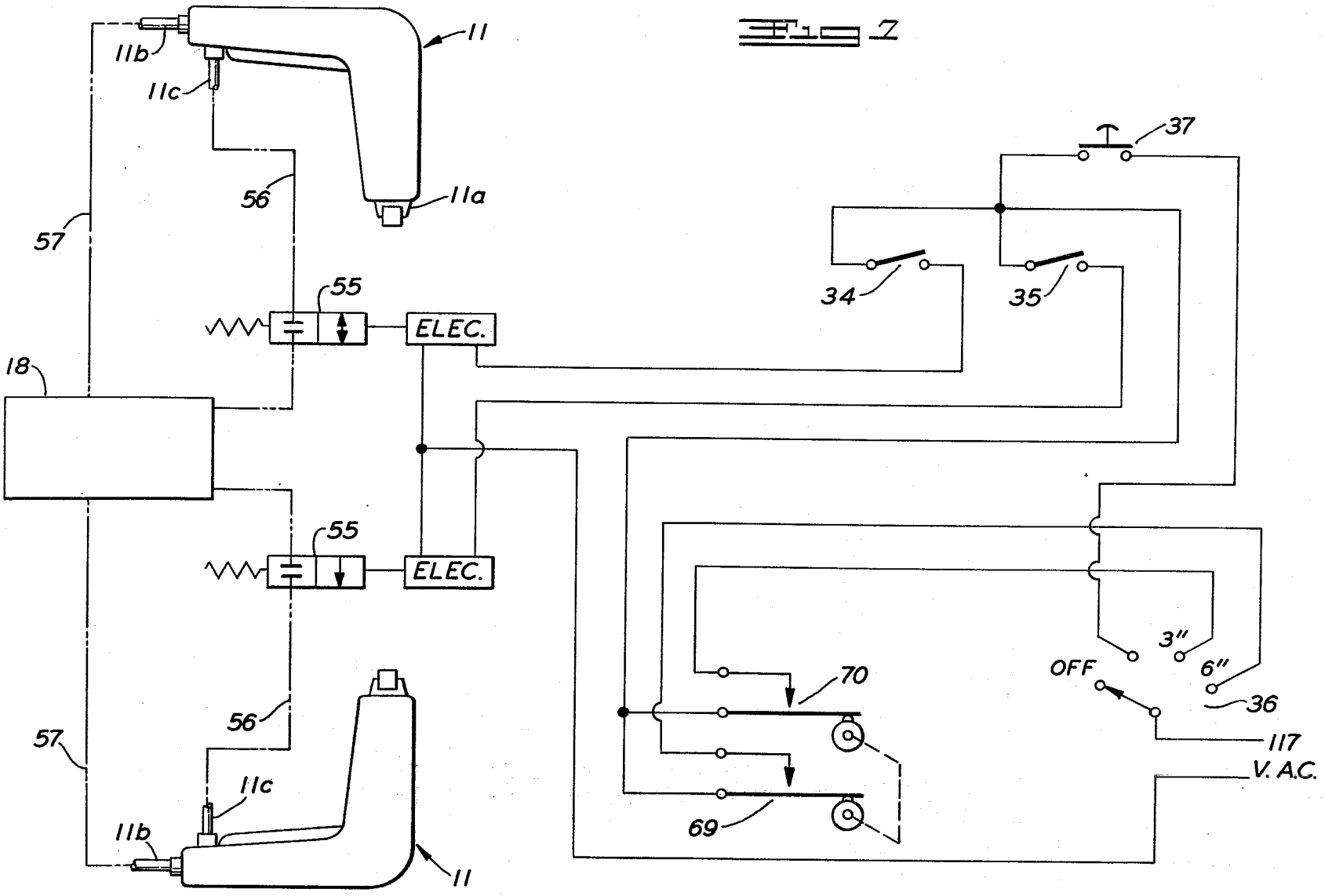
FIG. 7 is a schematic diagram of the electropneumatic control circuit.

The electrical control circuit is shown in FIG. 7 as connected with the solenoids of the two pilot air valves 55. Having specific reference to this circuit diagram, it will be readily seen that positioning of the selector switch 36 to energize either circuit associated with the 3 inches or 6 inches nail spacing will result in automatic operation of the nailing guns 11 to drive the nails at that spacing. Assuming that a 3 inches nail spacing is desired for both guns 11, the selector switch 36 would be positioned with its movable contact in the indicated position for that portion of the circuit. Both toggle switches 34 and 35 would be closed to permit energization of the solenoids for both pilot valves 55 and simultane-operation of both nailing guns. Subsequent movement of the apparatus over the sheathing surface S will then result in closing of the switches 69 and 70 as the cam lobes 76 and 77 revolve past the actuating levers 71 and 72. In this assumed mode of operation, only the switch 70 will be effective in completing a circuit through the toggle switches 34 and 35 to the valve solenoids. Energization of the solenoids of the valves 55 causes these valves to open, thereby admitting pilot air to the nailing gun valves 11c. This will result in operation of both nailing guns 11 at every 3 inches of travel of the nailing apparatus over the sheathing surface S.

Positioning of the selector switch 36 to place its movable contact in a position to energize that portion of the circuit associated with switch 69 will result in actuation of the nailing guns at a 6 inches interval. This difference results from the difference in the angular rotation required of the control wheel 60 in bringing a cam lobe into engagement with a respective actuating lever 72. Operation of he apparatus will otherwise be the same as described in the preceding paragraph.

As an alternative mode of operation, the operator may select a manual mode of firing for either or both nailing guns 11. This is accomplished by the push-button switch 37 connected into the circuit to bypass the switches 69 and 70. With either or both toggle switches 34 and 35 closed, actuation of the push button switch 37 will complete a circuit to the solenoids of the pilot valves 55 as determined by the position of the toggle switches. This mode of operation permits the operator to utilize the apparatus in situations where only a few nails are to be placed and may not be required to be in any specified linear placement.

It will be readily apparent from the foregoing detailed description of an illustrative embodiment of this invention that a novel nailing apparatus is provided to facilitate nailing of structural sheathing. This apparatus enables automatic and simultaneous operation of two nailing guns thereby effecting a substantial reduction in time required for nailing resulting in economic savings as well as enhancing the work operation for the operator. Incorporation of a resiliently mounted control wheel in the control circuit results in accurate placement of the nails at uniformly spaced intervals.

Having thus described this invention, what is claimed is:

1. A deck nailing apparatus comprising a carriage having a plurality of wheels for support thereof in traversing of a work surface into which nail-type fasteners are to be driven at predetermined spaced intervals along a specified path, at least two fastener driving devices mounted on said carriage in transversely spaced relationship to the direction of carriage travel, each of the fastener devices including a powered fastener driving mechanism and actuation means, and control means mounted on said carriage and interconnected in controlling relationship with said actuation means, said control means including a control wheel mounted on said carriage for movement and rotation in a vertical plane on an axis disposed transversely to the direction of carriage travel to engage a surface on which said carriage is positioned and whereby said wheel is revolved in response to traversing movement of said carriage over the surface, said control wheel mounted on said carriage by resilient means normally urging said wheel into contacting engagement with the surface.

2. A deck nailing apparatus according to claim 1 wherein said control wheel includes a plurality of cam lobes disposed in angularly spaced relationship to each other, and said control means includes cam actuated means mounted on said carriage in operative relationship to said cam lobes for providing a control signal to said actuation means in predetermined relationship to revolution of said control wheel.

3. A deck nailing apparatus according to claim 2 wherein said cam lobes are removably attached to a side of said wheel.

4. A deck nailing apparatus according to claim 2 wherein all of said plurality of cam lobes are formed on a plate which is removably attached to a side of said wheel.

5. A deck nailing apparatus comprising a carriage having a plurality of wheels for support thereof in traversing of a work surface into which nail type fasteners are to be driven at predetermined spaced intervals along a specified path, said carriage including an elongated member extending longitudinally thereof and pivotally mounted thereon for swinging movement in a vertical plane and resilient means coupled with said elongated member for urging said member to pivot in a predetermined direction, at least two fastener driving devices mounted on said carriage in transversely spaced relationship to the direction of carriage travel, each of the fastener devices including a powered fastener driving mechanism and actuation means, and control means mounted on said carriage and interconnected in controlling relationship with said actuation means, said control means including a control wheel mounted on said elongated member for rotation in a vertical plane on an axis disposed transversely to the direction of carriage travel to engage a surface on which said carriage is positioned in response to the pivotal urging of said elongated member by said resilient means, and to revolve in response to traversing movement of said carriage over the surface.

6. A deck nailing apparatus according to claim 5 which includes spring means disposed in operative relationship to said elongated member and said carriage to downwardly bias said control wheel.

7. A deck nailing apparatus comprising a carriage having a plurality of wheels for support thereof in traversing of a work surface into which nail-type fasteners are to be driven at predetermined spaced intervals along a specified path, at least two fastener driving devices mounted on said carriage in transversely spaced relationship to the direction of carriage travel, each of the fastener devices including a powered fastener driving mechanism and actuation means, and control means mounted on said carriage and interconnected in controlling relationship with said actuation means, said control means including a control wheel resiliently mounted on said carriage to engage a surface on which said carriage is positioned and revolved in response to traversing movement of said carriage over the surface with said control means responding to said control wheel to operate said fastener driving devices in predetermined relationship to traversing movement of said carriage, electrically actuated means connected in controlling relationship to the respective actuating means of each fastener driving device, and an electrical control circuit connected with said electrically actuated means including selectively operable switch means for controlling operation of each fastener driving device independently of the other.

8. A deck nailing apparatus according to claim 7 wherein said control wheel is provided with a plurality of cam lobes arranged in predetermined relationship to revolve with said wheel and said electrical control circuit includes switch means mounted in operative relationship to said control wheel cam lobes to be actuated in response to revolution thereof and effect operation of said fastener driving devices in relation to rotation of said control wheel.

* * * * *